US008220974B2

(12) United States Patent
Chen et al.

(10) Patent No.: US 8,220,974 B2
(45) Date of Patent: Jul. 17, 2012

(54) LED UNIT

(75) Inventors: Chin-Chung Chen, Taipei Hsien (TW); Hai-Wei Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 506 days.

(21) Appl. No.: 12/477,113

(22) Filed: Jun. 2, 2009

(65) Prior Publication Data

US 2010/0172140 A1 Jul. 8, 2010

(30) Foreign Application Priority Data

Jan. 5, 2009 (CN) ..... 2009 1 0300058

(51) Int. Cl.
*F21V 5/00* (2006.01)

(52) U.S. Cl. ..... 362/326; 362/255; 362/256; 362/268; 362/311.01; 362/311.02

(58) Field of Classification Search ..... 362/234, 362/227, 235, 248, 249.01, 249.15, 85, 102, 362/106, 107, 127, 132, 134, 184, 186, 253, 362/351, 356, 362, 410, 411, 412, 414, 183, 362/352

See application file for complete search history.

(56) References Cited

U.S. PATENT DOCUMENTS

| | | | | |
|---|---|---|---|---|
| 6,724,543 | B1 * | 4/2004 | Chinniah et al. | 359/718 |
| 7,111,964 | B2 * | 9/2006 | Suehiro et al. | 362/328 |
| 7,499,228 | B2 * | 3/2009 | Jeong et al. | 359/708 |
| 7,748,873 | B2 * | 7/2010 | Kim et al. | 362/328 |
| 2002/0163810 | A1 * | 11/2002 | West et al. | 362/307 |
| 2006/0083000 | A1 * | 4/2006 | Yoon et al. | 362/311 |
| 2007/0019416 | A1 * | 1/2007 | Han et al. | 362/307 |
| 2008/0239722 | A1 | 10/2008 | Wilcox | |
| 2009/0268471 | A1 * | 10/2009 | Chen et al. | 362/335 |
| 2010/0027271 | A1 * | 2/2010 | Wilcox et al. | 362/311.02 |

* cited by examiner

*Primary Examiner* — Anabel Ton
*Assistant Examiner* — Danielle Allen
(74) *Attorney, Agent, or Firm* — Altis Law Group, Inc.

(57) ABSTRACT

An LED unit includes an LED having a first optical axis and a transparent envelope receiving the LED therein. The envelope is a cylinder inclined towards a lateral side. The envelope includes two concave surfaces respectively defined at a top and a bottom thereof, and a convex surface formed on the top thereof. The two concave surfaces have the same second optical axis and the convex surface has a third optical axis. The second and third optical axes are parallel to each other and angled with the first optical axis. The second and third optical axes are inclined towards the same lateral side as that the envelope is inclined toward. The two concave surfaces and the convex surface are all aspheric.

17 Claims, 5 Drawing Sheets

LED UNIT

BACKGROUND

1. Technical Field

The present disclosure relates to a light emitting diode (LED) unit and, more particularly, to an LED unit comprising a transparent envelope having a favorable light-collimating capability.

2. Description of Related Art

LEDs, available since the early 1960's, has increasingly used in a variety of occasions, such as residential, traffic, commercial, and industrial, because of high light-emitting efficiency. Generally, different occasions require different illumination patterns. For example, a square may require a diffused illumination due to a large area thereof to be illuminated, and a stage may require a high-intensity illumination to be clearly presented to audience. For a road, particularly, a road for vehicle, a continuous and uniform illumination is even compellent for ensuring safe of the vehicle. Therefore, the LEDs are often arranged side-by-side in an enclosure of a lamp, thereby projecting light on the road without obvious dark spots. However, the LEDs generally cannot produce desirable light pattern by themselves due to size limitations thereof. Even after collimation by an encapsulant (often in the shape of lens) of the LED, the light output from the LED would still fall well short of such light pattern requirement.

Therefore, some optical structures are often incorporated to the lamp to adjust the light emitted from the LEDs. A most commonly used optical structure is reflector. The reflector is secured between the LEDs and the enclosure of the lamp to reflect the light emitted by the LEDs toward predetermined directions, thereby producing desirable light pattern over the road.

The reflector usually has a large volume so that all of the LEDs could be given attentions thereby. However, such a large volume of the reflector causes the reflector difficult to be manipulated, and accordingly results in assembly of the reflector to the enclosure of the LED lamp inconvenient. Furthermore, in order to achieve such desirable light pattern, corresponding parts of the reflector should be optimizedly configured according to different locations of the LEDs, which results in a high cost of the reflector.

What is needed, therefore, is an LED unit which can overcome the limitations described above.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
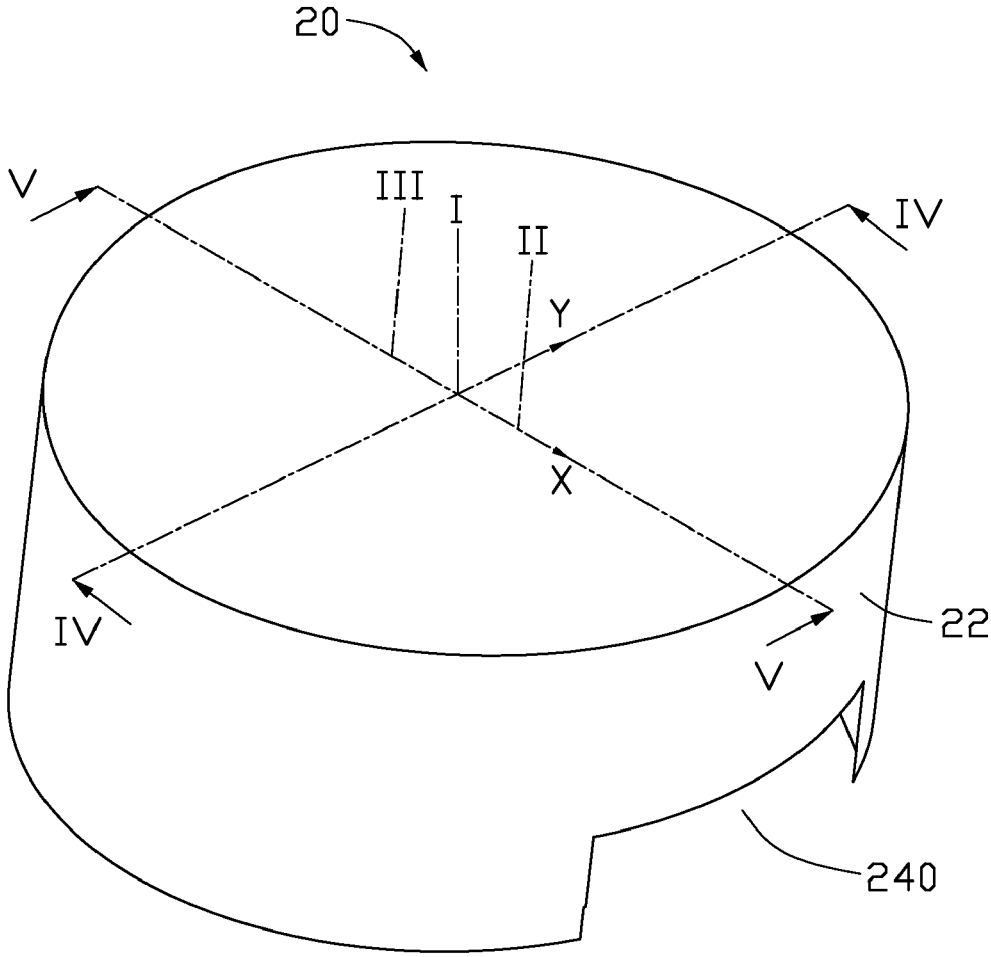
FIG. 1 is an isometric view of an LED unit of the disclosure.
Figure 4:
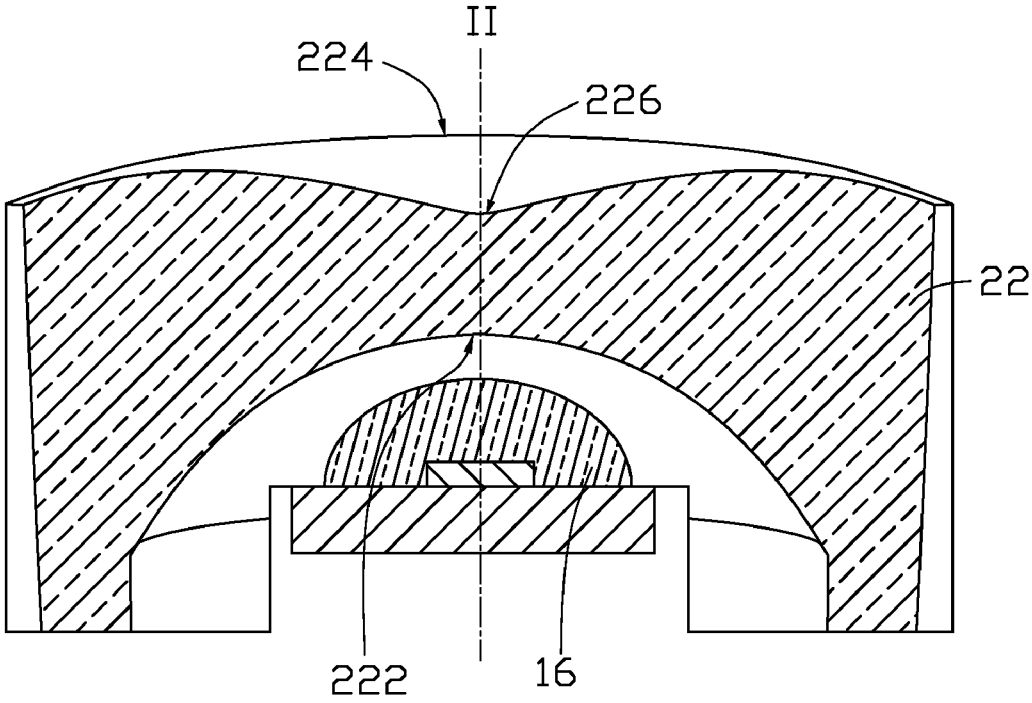
FIG. 4 is a cross-section of FIG. 1 taken along line IV-IV thereof.
Figure 5:
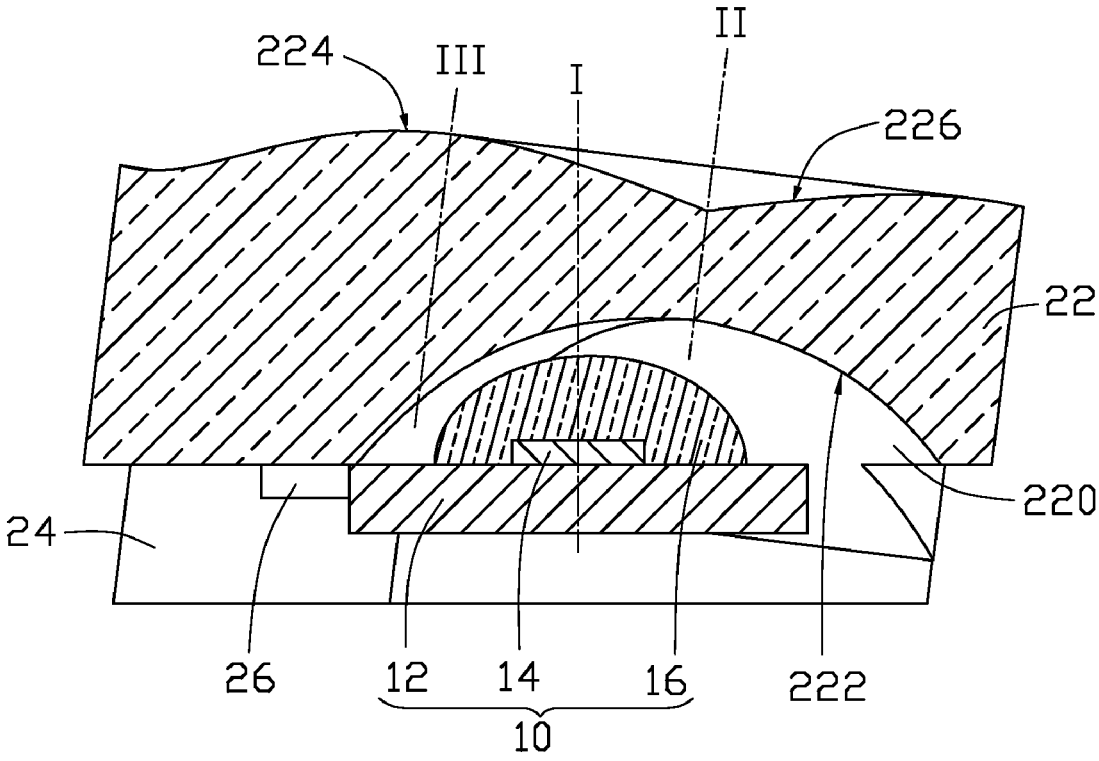
FIG. 5 is a cross-section of FIG. 1 taken along line V-V thereof.

Referring to FIGS. 1 and 4-5, an LED unit of the disclosure includes an LED 10 and an envelope 20 mounted over and around the LED 10. The LED 10 includes a substrate 12, an LED die 14 attached on a center of a top of the substrate 12, and an encapsulant 16 fixed on the top of the substrate 12 and sealing the LED die 14. The LED 10 is horizontally placed within the envelope 20 so that an optical axis of the LED 10 (marked as an axis I in FIGS. 4-5) is oriented vertically. Since a poor light-converging capability of the encapsulant 16 which even has a shape like a dome, light emerged out of the encapsulant 16 is still divergent over an upper space above the substrate 12.

Figure 2:
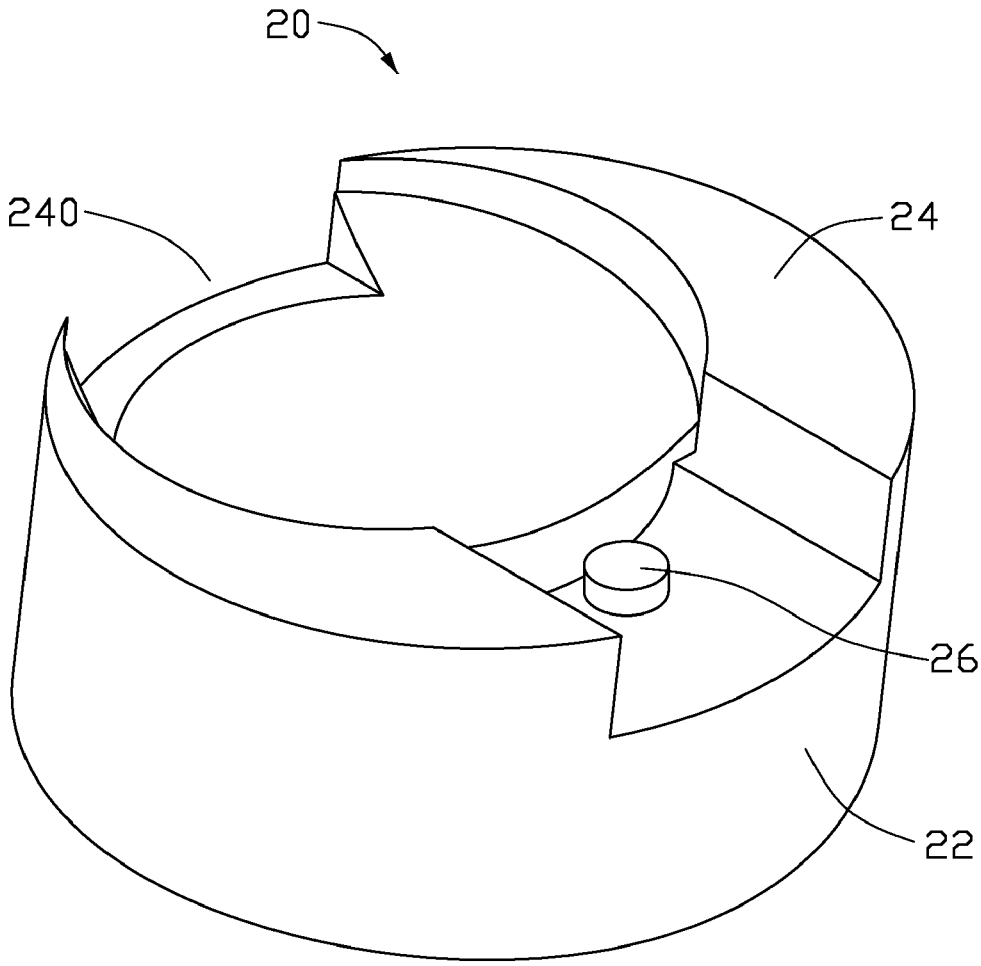
FIG. 2 is an inverted view of an envelope of the LED unit of FIG. 1.
Figure 3:
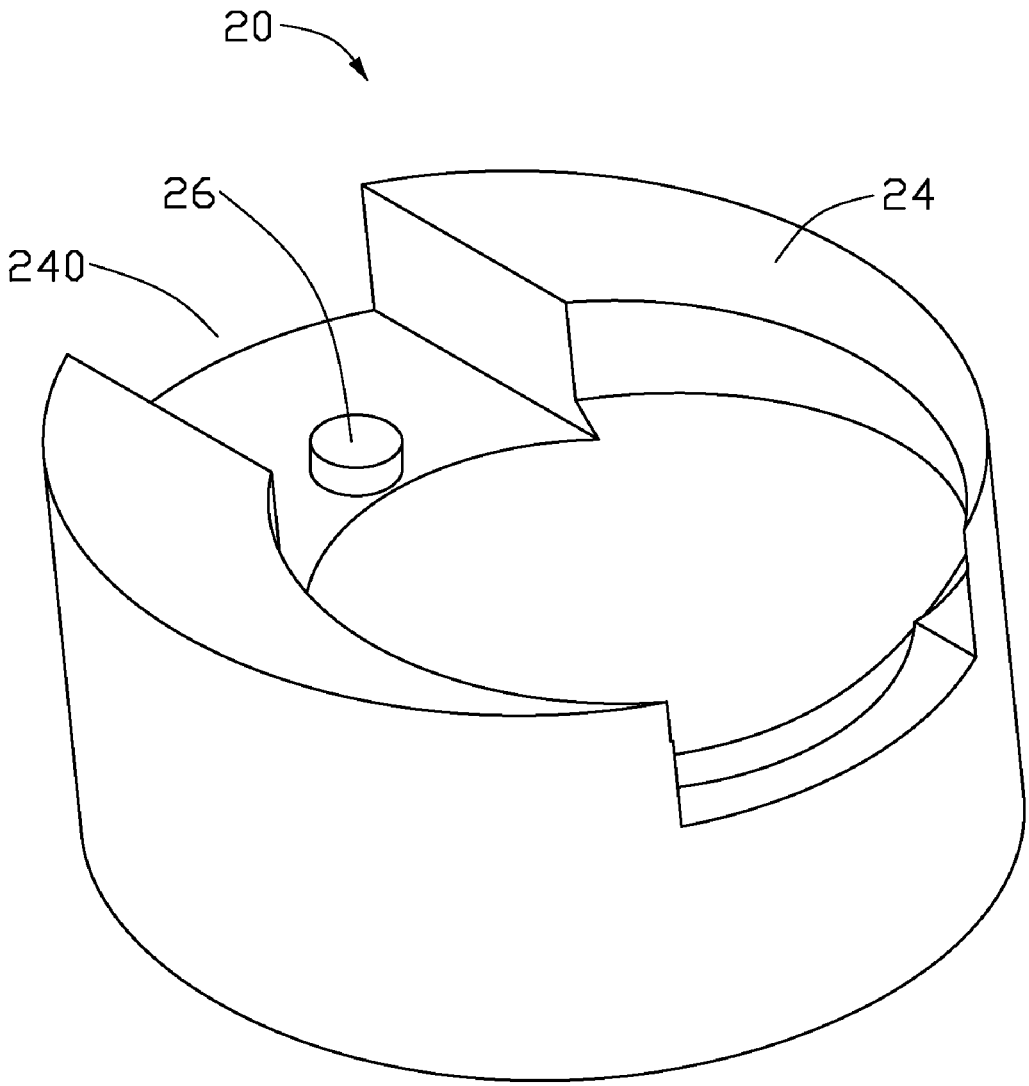
FIG. 3 is similar to FIG. 2, but viewed from another aspect.

Also referring to FIGS. 2-3, the envelope 20 is integrally made of a transparent material, such as PC or PMMA. The envelope 20 includes a main body 22 and a pair of strips 24 extending downwardly from a bottom face of the main body 22. The main body 22 is a rightwards inclined cylinder with an axis (not shown) thereof deviating an angle of about 10° from the axis I, thereby directing the light emitted from the LED 10 toward a right side. A part of the bottom face of the main body 22 forms a cavity 220 in the right of the envelope 20. The LED 10 is partially received in the cavity 220 with the substrate 12 thereof exposed out of the main body 22. A concaved inner surface 222 of the main body 22 defining the cavity 220 is aspheric and spaced from the encapsulant 16 of the LED 10 via a gap. An optical axis of the concaved surface 222 (marked as optical axis II in FIG. 5) is rightwards inclined relative to the axis I, whereby the light output from the encapsulant 16 of the LED 10 would be directed by the concaved surface 222 rightwards and upwardly into an interior of the main body 22. The pair of strips 24 each having a width increasing leftwards, as viewed from FIGS. 1 and 3, are symmetrically formed on opposite front and rear sides of the bottom face of the main body 22. The pair of strips 24 surround the substrate 12 of the LED 10 to confine the LED 10 in the envelope 20. Every two opposite ends of the two strips 24 are spaced from each other to define two cutouts 240 in the right side and a left side of the envelope 20, respectively. A post 26 is protruded downwardly from the bottom face of the main body 22 into a left cutout 240 between the two strips 24, wherein the left cutout 240 has a radial width larger than that of the right cutout 240. The post 26 is for abutting against a circumference of the substrate 12 to thereby position the LED 10 at the proper place within the envelope 20.

A top face of the main body 22 includes a convex surface 224 and a concave surface 226 adjacent to the convex surface 224. The upper concave surface 226 is located corresponding to the lower concave surface 222. Both the convex surface 224 and the upper concave surface 226 are aspheric for more effectively consolidating the light from the interior of the main body 22 to a desired pattern. The upper concave surface 226 has an optical axis II collinear with that of the lower concave surface 222, and the convex surface 224 has an optical axis III parallel to the optical axis II. The optical axes II and III are located at two flanks of the optical axis I, and both are rightwards inclined so that each of them is deviated an acute angle (preferably about 10°) from the optical axis I of the LED 10; thus, most of the light traveling through the interior of the main body 22 is directed rightwards and upwardly out of the envelope 20, and only a small part of the light escapes out of the envelope 20 from the left side. A coordinate (see FIG. 1) is introduced to more clearly define locations of the optical axes I, II and III, wherein the coordinate has an axis X and an axis Y perpendicular to the axis X, both of which cooperatively define a plane perpendicular to the optical axis I of the LED 10. A vertical extension of the axis X through the envelope 20 can divide the envelope 20 into two identical halves. The optical axis I extends vertically upwardly through an intersection between the axes X and Y The optical axis II extends rightwards upwardly through a point of the axis X in right of the intersection between the axes X and Y and the optical axis III extends rightwards upwardly through a point of the axis X in left of the intersection between the axes X and Y A distance between the intersections between the axis X and the optical axes I and II is equal to that between the intersection between the axis X and the optical axes I and III. An intersection between the top of the envelope 20 and the first optical axis I is located between intersections between the second and third optical axes II, III and the top of the envelope 20 along a right-left direction of the envelope 20, as clearly viewed from FIG. 5. By such arrangement, the light pattern presented by the LED unit is symmetrical along the axis Y in respect to the axis X, and deflected toward the right side along the axis X. The main body 22 has an uneven thickness which is increased from a central position towards the front and rear sides of the main body 22. A thickness of the main body 22 along the axis X has the smallest size at a position wherein the second optical axis II extends through the main body 22 of the envelope 20.

When multiple LED units are arranged in an enclosure (not shown) of an LED road lamp mounted at a side of a road, in which the LED units are arranged in a line along a width of the road and in a manner that the axis X is oriented parallel to the width of the road and the axis Y is oriented parallel to a length of the road, the light pattern of the LED road lamp could favorably satisfy the illumination requirement of the road. Most light output from the LED road lamp is converged toward the road, thereby providing sufficient luminosity to the vehicle running on the road; remaining less light emerged from an the LED road lamp is directed to the side of the road where a sidewalk is often provided, thereby illuminating the sidewalk. Furthermore, the symmetrical light pattern along the axis Y of the LED unit can ensure a uniform illumination provided by the LED road lamp at front and rear sides of the LED lamp along the length of the road.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

The invention claimed is:

1. An LED (light emitting diode) unit, comprising:

an LED having a first optical axis; and a transparent envelope receiving the LED therein; wherein the transparent envelope having a second optical axis angling with the first optical axis of the LED;

wherein the envelope has a first concave surface, the second optical axis being the optical axis of the first concaved surface;

wherein a cavity is defined in a bottom of the envelope to receive the LED therein, the first concave surface being an inner surface of the envelope defining the cavity; and wherein the envelope further comprises two spaced strips formed at the bottom thereof, the cavity being surrounded by the two spaced strips.

2. The LED unit as claimed in claim 1, wherein the envelope further comprises a second concave surface defined in a top thereof, the second concave surface having an optical axis collinear with the second optical axis.

3. The LED unit as claimed in claim 2, wherein the envelope further comprises a convex surface at the top thereof and adjacent to the second concave surface, the convex surface having a third optical axis.

4. The LED unit as claimed in claim 3, wherein the first, second and third optical axes intersect with a line whose vertical extension divides the envelope into two identical halves.

5. The LED unit as claimed in claim 4, wherein a distance between intersections between the line and the first and second optical axes is equal to that between intersections between the line and the first and third optical axes.

6. The LED unit as claimed in claim 5, wherein the first optical axis of the LED is vertically extended and the second and third optical axes are inclined from the first optical axis of the LED.

7. The LED unit as claimed in claim 3, wherein the second optical axis is parallel to the third optical axis, and an intersection between the top of the envelope and the first optical axis is located between intersections between the second and third optical axes and the top of the envelope.

8. The LED unit as claimed in claim 3, wherein the first and second concave surfaces and the convex surface are aspheric.

9. The LED unit as claimed in claim 1, wherein the envelope further comprises a post protruded downwardly between two opposite ends of the two spaced strips, the post abutting against a circumference of the LED.

10. The LED unit as claimed in claim 1, wherein the envelope is a cylinder inclined toward the same orientation as that the second optical axis is inclined toward.

11. An LED unit comprising:

an LED having a first optical axis perpendicular to a plane defined by a first axis and a second axis of a coordinate; and a transparent envelope comprising a main body receiving the LED therein, in which a vertical extension of the first axis through the envelope divides the envelope into two identical halves;

wherein the main body has a thickness gradually increasing from a center of the main body toward a front and a rear of the main body along the second axis;

wherein the first optical axis and at least an optical axis of the envelope intersect with the first axis at different points of the first axis; and wherein the envelope has a cavity defined in a bottom thereof and two spaced strips formed at the bottom thereof, the cavity being surrounded by the two spaced strips.

12. The LED unit as claimed in claim 11, wherein the envelope has two optical axes intersect with the first axis at different points, and the intersected point between the first optical axis and the first axis is located between the intersected points between the two optical axes of the envelope and the first axis.

13. The LED unit as claimed in claim 12, wherein the envelope comprises two concave surfaces respectively defined at a top and a bottom thereof, and a convex surface located on the top thereof, one of the two optical axes of the envelope extends through the concave surfaces of the envelope and the other one of the two optical axes of the envelope extends the convex surface, and wherein the two optical axes of envelope are inclined relative to the first optical axis of the LED.

14. The LED unit as claimed in claim 13, wherein a thickness of the main body along the first axis has the smallest size at a position wherein the one of the two optical axes of the envelope extends through the envelope.

15. The LED unit as claimed in claim 13, wherein the two concave surfaces and the convex surface of the envelope are aspheric.

16. An LED (light emitting diode) unit, comprising:

an LED having a first optical axis vertically extended; and an envelope located over and receiving the LED therein; wherein the envelope defining a bottom concave surface facing and spaced from the LED, the bottom concave surface having a second optical axis inclined rightwards with a first angle deviating from the first optical axis;

wherein the envelope defining a top convex surface having a third optical axis inclined rightwards with a second angle deviating from the first optical axis; and wherein the envelope has a cavity defined in a bottom thereof and two spaced strips formed at the bottom thereof, the cavity being surrounded by two spaced strips.

17. The LED unit as claimed in claim 16, where an intersection between a top of the envelope and first optical axis is located between the intersections between the top of the envelope and the second and third optical axes along a left-right direction.

* * * * *